US009139036B2

(12) United States Patent
Jewson

(10) Patent No.: US 9,139,036 B2
(45) Date of Patent: Sep. 22, 2015

(54) WRITING DEVICE

(71) Applicant: Andrew Alexander Jewson, Bicester (GB)

(72) Inventor: Andrew Alexander Jewson, Bicester (GB)

(73) Assignee: Jackpen Limited, Little Chesterton (GB)

( * ) Notice: Subject to any disclaimer, the term of this patent is extended or adjusted under 35 U.S.C. 154(b) by 294 days.

(21) Appl. No.: 13/866,845

(22) Filed: Apr. 19, 2013

(65) Prior Publication Data

US 2014/0044470 A1 Feb. 13, 2014

(30) Foreign Application Priority Data

Aug. 7, 2012 (GB) ..... 1214113.1

(51) Int. Cl.

| | |
|---|---|
| ***B43K 29/00*** | (2006.01) |
| ***B43K 23/00*** | (2006.01) |
| ***B43K 25/00*** | (2006.01) |
| ***B43K 29/02*** | (2006.01) |
| ***B43K 29/08*** | (2006.01) |
| ***B43K 31/00*** | (2006.01) |

(52) U.S. Cl.

CPC ..... *B43K 29/00* (2013.01); *B43K 23/00* (2013.01); *B43K 25/00* (2013.01); *B43K 29/02* (2013.01); *B43K 29/08* (2013.01); *B43K 31/00* (2013.01)

(58) Field of Classification Search

CPC ..... B43K 29/00; B43K 29/08; B43K 25/00
USPC ..... 401/195; 345/179
See application file for complete search history.

(56) References Cited

U.S. PATENT DOCUMENTS

| | | | |
|---|---|---|---|
| 6,659,673 | B1 | 12/2003 | Haffner et al. |
| 2004/0113897 | A1 | 6/2004 | Brumfield |
| 2014/0016811 | A1 | 1/2014 | Fang et al. |

FOREIGN PATENT DOCUMENTS

| | | | | |
|---|---|---|---|---|
| CN | 2891515 | Y | | 4/2007 |
| CN | 101284472 | A | * | 10/2008 |
| CN | 201205818 | Y | | 3/2009 |
| CN | 201388217 | Y | | 1/2010 |
| CN | 201937650 | U | | 8/2011 |

(Continued)

OTHER PUBLICATIONS

Search and Examination Report, Great Britain Patent Application No. GB1101039.4, Nov. 18, 2011, 6 pages.

(Continued)

*Primary Examiner* — Jennifer C Chiang
(74) *Attorney, Agent, or Firm* — Lewis Rice LLC

(57) ABSTRACT

An apparatus comprises a writing device and an electronic device. The electronic device comprises a headphone socket and the writing device is elongate and comprises first and second ends. The first end is shaped to be received by and releasably retained in the headphone socket of the electronic device. The second end is shaped to allow a user to withdraw the writing device from the headphone socket of the electronic device when the first end is retained in the headphone socket. In a first, housed configuration the first end is releasably retained in the headphone socket and the second end is exposed remote from the electronic device. In a second, writable configuration the second end is releasably retained in the headphone socket and the first end is exposed remote from the electronic device to enable the writing device, in combination with the electronic device, to be used to write with.

26 Claims, 6 Drawing Sheets

(56) References Cited

FOREIGN PATENT DOCUMENTS

| | | | |
|---|---|---|---|
| DE | 29910384 | U1 | 3/2000 |
| EP | 2388855 | A1 | 11/2011 |
| ES | 2167216 | A1 | 5/2002 |
| JP | 2002009913 | A | 1/2002 |
| JP | 2004195952 | A | 7/2004 |
| JP | 2009090484 | A | 4/2009 |
| JP | 31766667 | U | 6/2012 |
| KR | 20120006596 | A | 1/2012 |
| NL | 1038411 | C | 5/2012 |
| TW | 201102803 | A | 1/2011 |
| WO | 2005029343 | A1 | 3/2005 |

OTHER PUBLICATIONS

Jackpen, http://www.jackpen.com, printed on Apr. 19, 2013, 1 page.
Search Report, Great Britain Patent Application No. GB1307140.2, Jun. 14, 2013, two pages.
Search Report, Great Britain Patent Application No. GB1214113.1, Jan. 23, 2014, four pages.
Search Report, International Application No. PCT/GB2013/052097, Oct. 2, 2013, 12 pages.

* cited by examiner

WRITING DEVICE

CROSS REFERENCE TO RELATED APPLICATION(S)

This application claims priority to British Patent Application Serial No. 1214113.1, filed Aug. 7, 2012, the entire disclosure of which is incorporated herein by reference.

BACKGROUND

1. Field of the Invention

This invention relates to a writing device. It relates particular to a writing device for use with an electronic device.

2. Description of Related Art

Many writing devices are known which enable a user to generate an ink or other pigment deposition on a surface, e.g. a pen or pencil. These include elongate devices which are in two parts: a writing part having a nib or tip from which ink or other pigment medium can be dispensed while in contact with a writing surface; and a capping part for protecting the nib or tip when the device is not in use.

SUMMARY

Described herein, among other things is a writing device and electronic device in combination, the combination comprising: an electronic device including a headphone socket; and an elongated writing device including a first end and a second end; wherein, the first end is shaped to be received by and releasably retained in the headphone socket of the electronic device; wherein, the second end is shaped to allow a user to withdraw the writing device from the headphone socket of the electronic device when the first end is retained in the headphone socket; and wherein, in a housed configuration, the first end is releasably retained in the headphone socket and the second end is exposed remote from the electronic device; and in a writable configuration, the second end is releasably retained in the headphone socket and the first end is exposed remote from the electronic device to enable the writing device, in combination with the electronic device, to be used to write with.

In an embodiment of the combination, the first end comprises a nib at the first end.

In an embodiment of the combination, the nib is arranged to dispense a pigment when used to write on a surface.

In an embodiment of the combination, the pigment is ink and the writing device further comprises a cavity to store the ink.

In an embodiment of the combination, the nib is shaped such that it can be used as a stylus.

In an embodiment of the combination, the second end comprises a nib, wherein the nib comprises a stylus.

In an embodiment of the combination, the electronic device is a mobile phone.

In an embodiment of the combination, the second end is shaped such that it may be received by and releasably retained in the headphone socket of the electronic device.

In an embodiment of the combination, the headphone socket and the first end of the writing device are configured to be rotationally symmetric about respective longitudinal axes of the headphone socket and the writing device.

In an embodiment of the combination, the second end is shaped not to be received by and/or retained in the headphone socket of the electronic device.

In an embodiment of the combination, the first end is shaped to engage with a resilient retaining mechanism located in the headphone socket.

In an embodiment of the combination, the first end comprises a circumferential rib, collar or groove at its terminal end which engages with the resilient retaining mechanism.

In an embodiment of the combination, the second end comprises a circumferential collar which protrudes in a direction generally perpendicular to a length of the writing device, at the boundary between the first and second ends.

In an embodiment of the combination, the second end comprises a circumferential indentation to aid withdrawal of the writing device from the headphone socket.

There is also described herein an elongate writing device comprising: a first end; and a second end; wherein, the first end is sized and shaped to be received by and releasably retained in the headphone socket of an electronic device; wherein the second end is shaped to allow a user to withdraw the writing device from the headphone socket of the electronic device when the first end is retained in the headphone socket; and wherein in a housed configuration, the first end is releasably retained in the headphone socket and the second end is exposed remote from the electronic device; and in a writable configuration, the second end is releasably retained in the headphone socket and the first end is exposed remote from the electronic device to enable the writing device to be used to write with.

In an embodiment the first end comprises a nib.

In an embodiment of the device, the nib is arranged to dispense a pigment when used to write on a surface.

In an embodiment of the device, the pigment is ink and the writing device further comprises a cavity to store the ink.

In an embodiment of the device, the nib is shaped such that it can be used as a stylus.

In an embodiment, the second end comprises a nib, the nib comprising a stylus.

In an embodiment of the device, the second end is shaped such that it may be received by and releasably retained in the headphone socket of the electronic device.

In an embodiment of the device, the second end is shaped not to be received by and/or retained in the headphone socket of the electronic device.

In an embodiment of the device, the first end is shaped to engage with a resilient retaining mechanism located in the headphone socket.

In an embodiment of the device, the first end comprises a circumferential rib, collar or groove at its terminal end which engages with the resilient retaining mechanism.

In an embodiment of the device, the second end comprises a circumferential collar which protrudes in a direction generally perpendicular to a length of the device, at the boundary between the first and second ends.

In an embodiment of the device, the second end comprises a circumferential indentation to aid withdrawal of the writing device from the headphone socket.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment.

DESCRIPTION OF THE PREFERRED EMBODIMENTS

Figure 1:
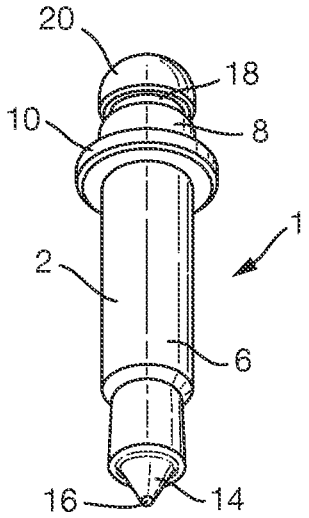
FIG. 1 is a perspective view of an embodiment of a writing device.

There is described an apparatus comprising a writing device either alone or in combination with an electronic device; the electronic device comprising a headphone socket arranged to receive and releasably retain a conventional headphone jack plug and allow rotation of the jack plug relative to the headphone socket; the writing device being elongate and comprising first and second ends; wherein the first end comprises a nib and is shaped to be received by and releasably retained in the headphone socket of the electronic device; and wherein the second end is shaped to be received by and releasably retained in the headphone socket of the electronic device; and wherein in a first, housed configuration the first end is releasably retained in the headphone socket and the second end is exposed remote from the electronic device; and in a second, writable configuration the second end is releasably retained in the headphone socket and the first end is exposed remote from the electronic device to enable the writing device, in combination with the electronic device, to be used to write with.

There is also described an elongate writing device comprising first and second ends; wherein the first end comprises a nib shaped to be received by and releasably retained in a headphone socket of an electronic device, wherein the headphone socket of the electronic device is arranged to receive and releasably retain a conventional headphone jack plug and allow rotation of the jack plug relative to the headphone socket; and wherein the second end is shaped to be received by and releasably retained in the headphone socket of the electronic device; and wherein in a first, housed configuration the first end is releasably retained in the headphone socket and the second end is exposed remote from the electronic device; and in a second, writable configuration the second end is releasably retained in the headphone socket and the first end is exposed remote from the electronic device to enable the writing device to be used to write with.

Thus, it will be appreciated, that this aspect of the invention provides a writing device which can be stored conveniently in the headphone socket of an electronic device, which may otherwise not be used. The writing device is retained such that it does not fall out accidentally but rather has to be pulled out by a user and the nib of the writing device may be protected by the headphone socket when not in use. The writing device therefore obviates the need for a user to carry a further writing device, e.g. a pen, around with them, particularly as many people now carry a mobile phone on their person at most times, making the writing device ubiquitously available.

Furthermore, the writing device is generally configured such that its second end, opposite to the nib in the first end, can be held in the socket such that the electronic device can be held while using the writing device to write with. As will be appreciated, this is particularly convenient in the embodiments in which the electronic device is a mobile phone, as it allows the relatively small writing device to be manipulated more comfortably compared to a user holding the writing device directly.

There is also described an elongate writing device comprising first and second ends; wherein the first end is shaped to be received by and releasably retained in the headphone socket of an electronic device; and wherein the second end is shaped to allow a user to withdraw the writing device from the headphone socket of the electronic device when the first end is retained in the headphone socket.

In these and other aspects, the writing device is elongate along an axis, i.e. it is generally straight along its length with a length greater than its width, the length being in a direction parallel to its axis and the width being in a direction perpendicular to its axis. Generally the first and second ends are coaxial and preferably the writing device is rotationally symmetric though this may not always be the case in some aspects and embodiments of the invention. Thus the writing device may be substantially cylindrical, extending along the main axis of the cylinder. The first end is generally taken to be the portion of the writing device which is retained in the headphone socket when the writing device is not being used for writing, and the second end is the portion of the writing device which is exposed when the first end is retained, e.g. to allow a user to withdraw the writing device from the headphone socket of the electronic device when the first end is retained in the headphone socket. Preferably the first end is longer than the second end. Generally the second end will protrude from the headphone socket of the electronic device by a finite length when the first end is retained in the headphone socket to allow the writing device to be removed from the headphone socket, however the second end may have a very short length to reduce the amount by which it protrudes from the electronic device. For example, in the embodiments in which the electronic device is handheld, it may be uncomfortable when the electronic device is stored in a user's pocket if the second end significantly protrudes from the electronic device.

The nib of the writing device, i.e. the tip which is used to contact the surface on which the writing is performed, is generally located at the terminal tip of the first end of the writing device, i.e. distal from the second end. However embodiments are envisaged in which the nib is retractable from the terminal tip of the second end of the writing device, i.e. distal from the first end. In a set of such embodiments the first end is rotatable about the axis of the writing device with respect to the second end such that rotation of the device exposes the nib at the terminal tip of the second end of the writing device. For example the writing device could comprise two generally concentric bodies, preferably with a thread between the bodies such that rotating the first end, i.e. one of the bodies, with the respect to the second end, i.e. the other of the bodies, extends the length of the writing device by exposing the inner body from the outer body. This telescopic embodiment has the advantage that the whole of the first end is retained within the headphone socket, making the writing device more secure to use when holding a handheld electronic device, compared to the embodiments in which the nib of the writing device is at the terminal tip of the first end and the second end is retained in the headphone socket to write with the writing device. Furthermore, both terminal ends of the writing device could comprise respective nibs, which may have different functions for example, as will be discussed in more detail below.

The electronic device could be any electronic device with a headphone socket in which a user wishes to store the writing device, e.g. a CD player, hi-fi, personal computer, laptop or tablet, but preferably the electronic device is a handheld electronic device, e.g. a music player, a portable gaming device or a mobile phone. A mobile phone is a particularly convenient electronic device for use with the present invention as often the headphone socket is not being used in conjunction with a pair of headphones or earplugs, e.g. compared to a music player, and mobile phones are common devices for people to have on their person at most times nowadays.

In an embodiment, the second end is shaped such that it may be received by and releasably retained in the headphone socket of the electronic device, e.g. leaving the first end exposed from the headphone socket. This enables the writing device, in the embodiments in which the nib is at the terminal tip of the first end, to be held in the headphone socket such that the electronic device can be held while using the writing device to write. Thus the first end will protrude from the electronic device when the second end is retained in the headphone socket, to allow the nib at the terminal tip of the first end to be used. As will be appreciated, this is particularly convenient in the embodiments in which the electronic device is handheld, as it allows the relatively small writing device to be manipulated more comfortably compared to a user holding the writing device directly.

The writing device may be arranged such that the writing device cannot rotate when either or both of the first and second ends are retained in the headphone socket. In these embodiments the writing device may comprise specific features to engage with features within the headphone socket to prevent rotation. The writing device can then be arranged to fit into this headphone socket which enables the writing device to be held securely. This is of particular benefit when the second end is retained in the headphone socket as it prevents rotation of the writing device when it is being used to write with. If the second end is not rotationally symmetric this may also aid withdrawal of the writing device from the electronic device when the first end is retained in the headphone socket, e.g. the second end could be flattened to enable a user to pinch the second end. Additionally the non-symmetric profile of the second end could match the narrow profile of a mobile phone such that the protrusion of the second end is kept to a minimum.

However, in another embodiment, the headphone socket and at least the first end of the writing device may be configured to be rotationally symmetric about the respective longitudinal axes of the headphone socket and the writing device. Thus the writing device does not have to be oriented correctly to fit into the headphone socket, allowing the writing device to be inserted easily into the headphone socket. Furthermore, the writing device may be able to rotate when it is retained in the headphone socket.

In a still further embodiment, the second end is shaped not to be received by and/or retained in the headphone socket of the electronic device. This is considered to be novel and inventive in its own right and thus when viewed from a further aspect the invention provides an elongate writing device comprising first and second ends; wherein the first end is shaped to be received by and releasably retained in the headphone socket of an electronic device; and wherein the second end is shaped not to be received and/or retained in the headphone socket of the electronic device.

The skilled person will appreciated that there are a number of reasons why having the second end shaped not to be received and/or retained in the headphone socket of the electronic device may be advantageous. For example, the width of the second end (in the direction perpendicular to the main longitudinal axis) may be wider than the corresponding width of the headphone socket, i.e. such that the second end cannot be received in the headphone socket. This enables a user to grip more easily onto the second end to withdraw the writing device from the headphone socket. Alternatively the width of the second end may be narrower than the corresponding width of the headphone socket, i.e. such that the second end cannot be retained in the headphone socket. This enables the second end to have a smaller profile to make it less protrusive or to shape it to give it a further function, e.g. a capacitive point as will be discussed below.

In this embodiment, as discussed for previous aspects, the second end of the writing device may comprise a nib at its terminal tip. This allows the writing device to be used without having to withdraw the first end from the headphone socket. The nib may be retractable, though this is not essential. Additionally or alternatively the first end may comprise a nib located at its terminal tip so that the writing device can be withdrawn from and used without the electronic device.

In all aspects of the first end could be any length which is equal to or shorter than the length of the headphone socket, but will generally be approximately the same length as the headphone socket and have similar dimensions to a headphone jack, i.e. approximately 19 mm in length and approximately 3.5 mm in width. Correspondingly, the second end may be any convenient length. As has been discussed above, the second end will generally be shorter than the first end to minimise its protrusion from the electronic device. Therefore preferably the second end is less than 15 mm in length, more preferably less than 10 mm in length, e.g. less than 6 mm in length. Thus the total length of the writing device is preferably less than 35 mm in length, more preferably less than 30 mm in length, e.g. less than 25 mm in length. However in some embodiments a second end with a longer length may be desired, e.g. to aid withdrawal of the first end of writing device from the headphone socket or so that the writing device can more easily be held when removed from the electronic device, e.g. in the aspects and embodiments in which the second end cannot be retained in the headphone socket.

As has been discussed above, in preferred embodiments the first and second ends are generally cylindrical about a common axis. In most embodiments, apart from the nib, the writing device is made from plastic, e.g. injection moulded plastic. The first and second ends could have a constant circular cross section without any embellishments or features at any point along the length of the writing device. However, the Applicant has designed a number of advantageous features that the writing device may comprise, e.g. determined by its shape.

The writing device may comprise a portion made from rubber or soft plastic, e.g. in a circumferential band at the join between the first and second ends, to aid retention of the first and/or second ends in the headphone socket.

In an embodiment the first end is shaped to engage with a resilient retaining mechanism located in the headphone socket, e.g. a sprung protrusion or ring. This is considered to be novel and inventive in its own right and therefore when viewed from a further aspect the invention provides an elongate writing device comprising first and second ends; wherein the first end is shaped to be received by and releasably retained in the headphone socket of an electronic device, and to engage with a resilient retaining mechanism located in the headphone socket so as to click into a retained position; and wherein the second end is shaped to allow a user to withdraw the writing device from the headphone socket of the electronic device when the first end is retained in the headphone socket.

The shape of the first end which engages with the resilient retaining mechanism located in the headphone socket acts to retain the writing device securely in the headphone socket, for example to prevent it being dislodged when accidentally knocked, and gives the user a satisfying "click" when the first end is pushed past the resilient retaining mechanism to confirm that the first end has engaged with the resilient retaining mechanism. Preferably the first end comprises a circumferential rib, collar or groove at its terminal end which engages with the resilient retaining mechanism. Alternatively or additionally the first end comprises a flared portion which increases in cross-sectional area towards the terminal tip of the first end to provide a shape which engages with the resilient retaining mechanism in the headphone socket.

The second end may have a rounded terminal tip to prevent it catching or snagging on things, e.g. when the first end of the writing device is retained in the headphone socket and the electronic device is stored in a user's pocket or bag. In one set of embodiments the second end comprises a circumferential collar which protrudes in a direction generally perpendicular to the main axis of the writing device, at the boundary between the first and second ends, i.e. the collar conveniently delimits the two ends from each other. Generally, by its protruding nature, the width of the collar, i.e. its diameter in a direction perpendicular to the main axis of the writing device, will be greater than the width of writing device and greater than the width of the headphone socket.

The collar gives a number of advantages. First, as the collar is generally wider than the headphone socket, the collar acts to limit the distance by which the writing device can be inserted into the headphone socket. This is of most benefit in the embodiments in which the second end can be inserted into the headphone socket, as the first end will generally be shaped such that its length is the limiting factor in preventing it being pushed any further into the headphone socket. Second, the collar may provide a protruding feature which a user can grip onto to aid removal of the writing device from the headphone socket, for when either or both of the first and second ends are retained in the headphone socket.

The collar may lie in a single plane and be perpendicular to the main axis of the writing device, e.g. to sit flush with the square edges of an iPhone®. However some mobile phones or other electronic devices do not have a casing which lies flat and perpendicular to the axis of the headphone socket, e.g. some models made by HTC® and Samsung®. Therefore in some embodiments the collar may lie in a plane at an oblique angle to the axis of the writing device, or the collar may be curved, i.e. not lie in a single plane. Additionally or alternatively the collar could be flexible, e.g. to conform its shape to that of the casing of the electronic device.

Alternatively or in addition to the collar, the second end may comprise a circumferential indentation, e.g. which extends all or part way round the circumference of the second end, to aid withdrawal of the writing device from the headphone socket, for example by a user gripping the indentation with their finger nails. Again alternatively or in addition to the collar and/or circumferential indentation, the second end may comprise a circumferential rib, e.g. which extends all or part way round the circumference of the second end, again to aid withdrawal of the writing device from the headphone socket. The rib may be located part way along the second end or at the terminal end of the second end.

In one set of embodiments the nib of the writing device, which as previously discussed is preferably located at the terminal tip of the first end, is arranged to dispense a pigment when used to write on a surface, e.g. paper. The pigment may be ink, e.g. from a ball point, rollerball, felt tip, gel pen, fountain pen or capillary action dip pen, though other types of ink dispensing arrangements are compatible with the writing device. The body of the writing device may comprise a cavity to store the ink in the embodiments in which an ink is dispensed by the nib, the cavity preferably being located in the end of the writing device in which the nib is located. Conveniently, the terminal tip of the writing device opposite the nib may comprise a hole in the body to aid the flow of ink out of the writing device.

Alternatively the pigment may be graphite, crayon, charcoal or chalk, e.g. such that the writing device operates in a similar manner to a pencil. The graphite, etc. could be arranged to be sharpened as in a traditional pencil with a wooden holder, or could be a mechanical, e.g. propelling pencil. This latter option is particularly suited to the embodiments in which the two ends are rotatable with respect to each other to reveal the nib. Embodiments are also envisaged in which the nib does not dispense a pigment but is shaped such that it can be used as a stylus, e.g. with a touch screen. The stylus may not have any particular material properties, making it suitable for use with a resistive touch screen, though the stylus may be capacitive so that it can also be used with a capacitive touch screen.

Although in preferred embodiments the writing device comprises only a single nib, e.g. located at the terminal tip of the first end, embodiments are envisaged in which the writing device comprises two nibs, one at each terminal end of the writing device. Both of these nibs could dispense a pigment, e.g. different coloured inks, or both could be shaped for use as a stylus, e.g. one for a resistive touch screen and the other for a capacitive touch screen. However in one set of embodiments one of the nibs, e.g. at the terminal tip of the first end, is arranged to dispense a pigment and the other nib, e.g. at the terminal tip of the second end, is shaped such that it can be used as a stylus. Further embodiments are also envisaged in which the end opposite the nib comprises, for example, a rubber for erasing pencil marks, or other accessories.

In the set of embodiments in which the nib is arranged to dispense a pigment, the pigment may be one of many different colours, e.g. black, blue, red, green, pink, etc. The body of the writing device may be made of a material having a colour which matches the colour of the pigment dispensed, e.g. a blue body for blue ink. Alternatively or additionally, the colour of the body may be matched to the colour of the case of the electronic device, e.g. a pink body to match a pink mobile phone cover to allow a user to "accessorise" their mobile phone.

There is also described an apparatus comprising an electronic device and a writing device as set out in any of the above aspects. Although certain embodiments and preferred features are set out in conjunction with certain aspects of the invention, this is not taken to be limiting and with all of the embodiments and preferred features being suitable for each of the aspects of the invention, where these are compatible.

As used herein the term "end" should not be construed as limited to an extremity but should rather be understood to encompass a part of the writing device having finite length such that it is possible for the first and second ends to make up a complete length of the writing device. Equally the first and second ends may have a length therebetween.

Figure 2:
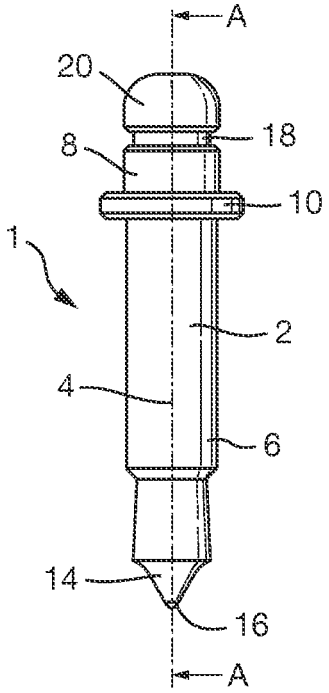
FIG. 2 is a side view of the writing device of FIG. 1.
Figure 3:
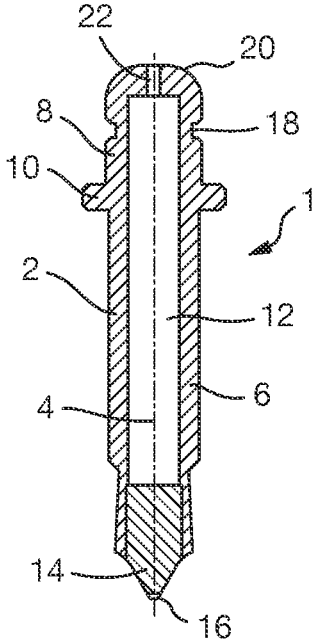
FIG. 3 is a cross-sectional view of the writing device of FIG. 1.

FIGS. 1 to 3 show a writing device 1 in accordance with a first embodiment, FIG. 1 showing a perspective view, FIG. 2 showing a side view, and FIG. 3 showing a cross-sectional view along the plane A-A shown in FIG. 2. The writing device 1 comprises a generally cylindrical body 2 which is elongate along the main axis 4 of the cylinder and is formed from injection moulded plastic. The body 2 comprises a first end 6 and a second end 8, and a circumferential collar 10 which extends around the cylindrical body 2 in a plane perpendicular to the main axis 4 of the cylinder and marks the boundary between the first end 6 and the second end 8. As can be seen from FIG. 3, the body 2 is hollow, defining a reservoir cavity 12 inside the body in which ink can be stored.

The first end 6 has a generally cylindrical shape which towards its terminal tip narrows and then gradually flares, increasing in cross-sectional area. At the terminal tip of the first end 6, the writing device 1 comprises a nib 14. The nib 14 includes a ball point 16 which is fed with ink from the reservoir 12, e.g. as is typical in conventional ball point pens. The second end 8 has a generally cylindrical shape, being coaxial with, and having a slight larger cross-section as, the first end 6. The second end 8 has a circumferential indentation 18 approximately half way along the second end 8 which extends around the second end 8. The terminal tip 20 of the second end is rounded and comprises an axially extending hole 22 through the main body 2 of the writing device to fluidically communicate with the reservoir 12 which allows the ink the flow unimpeded from the nib 14 when written with.

FIGS. 4 to 8 show various views of a writing device 41 in accordance with an embodiment of the invention which is very similar to that shown in FIGS. 1 to 3 and likewise is made from injection moulded plastic. The only difference is that the first end 42 of the writing device narrows to a constant cross-section before ending at the terminal tip 44 in a slightly wider circumferential rib 46 which extends around the first end 42.

Figure 4:
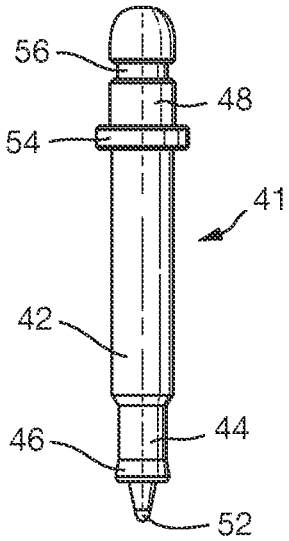
FIG. 4 is a side view of another embodiment of a writing device.
Figure 5:
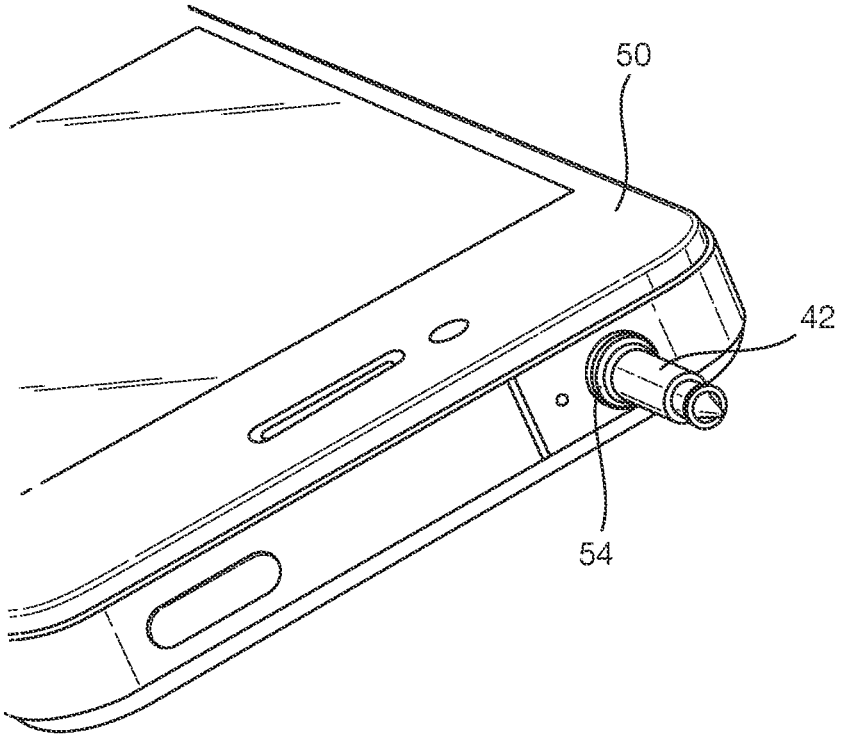
FIGS. 5 to 8 show various views of the writing device of FIG. 4 retained in a headphone socket of a mobile phone.
Figure 6:
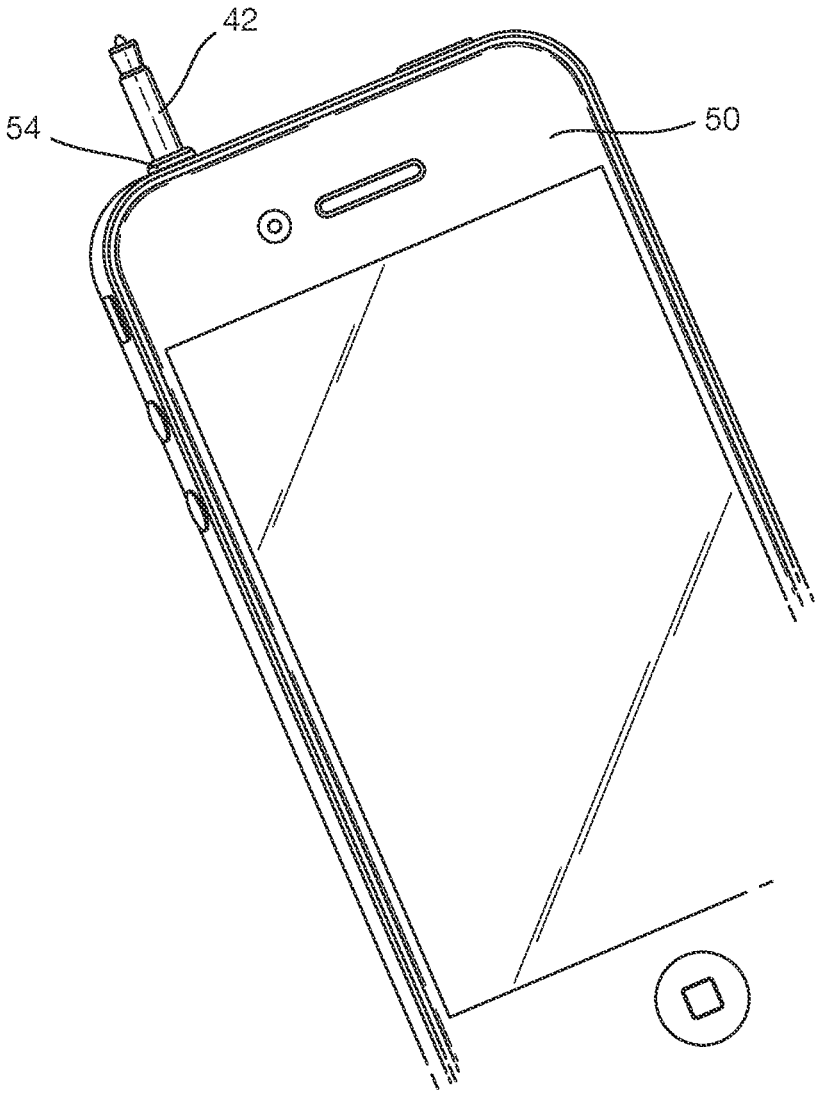
Figure 7:
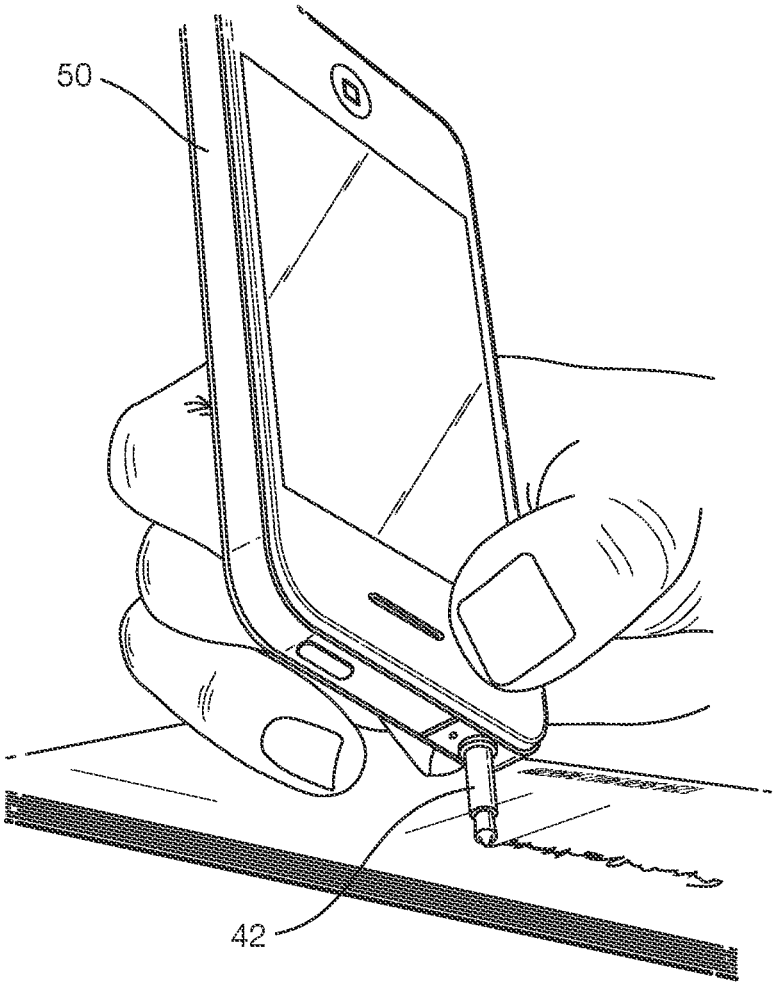
Figure 8:
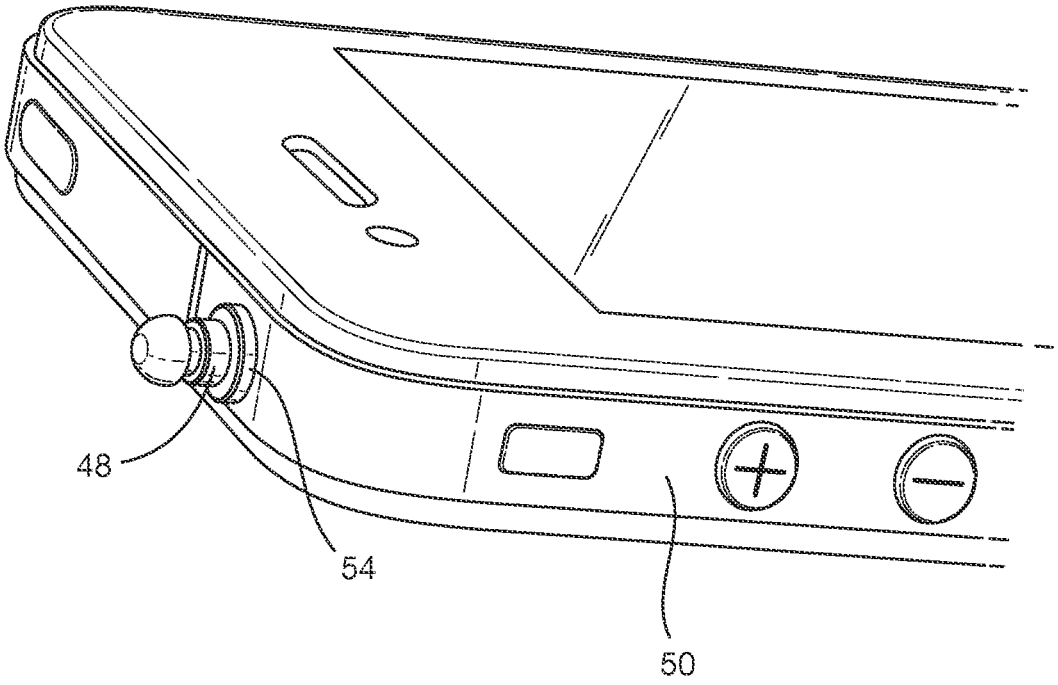

FIGS. 5 to 8 show various views of the writing device 41 of FIG. 4 retained by the headphone socket of a mobile phone 50. FIGS. 5 to 7 show the writing device 41 with the second end 48 inserted into and retained by the headphone socket, i.e. with the nib 52 at the terminal tip 44 of the first end 42 exposed, and FIG. 8 shows the writing device 41 with the first end 42 inserted into and retained by the headphone socket, i.e. with the second end 48 protruding. In each configuration, the respective end is received by the headphone socket such that the collar 54 of the writing device 41 lies flush with the edge of the mobile phone casing.

Operation of the writing device will now be described with reference to FIGS. 4 to 8. However the embodiments of the writing device shown in FIGS. 1 to 3 and 9 to 11 can be used in conjunction with a mobile phone in the same manner.

In operation a user takes the writing device 41 and inserts the first end 42 into the headphone socket of a mobile phone 50 where it can be stored. The generally cylindrical shape of the first end 42 is shaped such that it is received by the headphone socket. When a user pushes the first end 42 into the headphone socket the circumferential rib 46 will come into contact with a resilient retaining mechanism, namely a spring which forms part of a standard 3.5 mm headphone jack socket. The resilient retaining mechanism provides a resistance to the circumferential rib 46, but allows the rib 46 to be pushed past the resilient retaining mechanism to allow the first end 42 to be pushed further into the headphone socket, i.e. until the collar 54 lies flush with the edge of the mobile phone casing. The resilient retaining mechanism also prevents the writing device 41 easily falling out of the headphone socket as the circumferential rib 46 has to be pulled back past the resilient retaining mechanism to remove the first end 42 from the headphone socket.

With the first end 42 retained in the headphone socket, the second end 48 only protrudes slightly, as can be seen in FIG. 8, and is relatively inconspicuous. The writing device 41 can be stored conveniently in this configuration until it is required to be written with, thereby protecting the nib 52. When the writing device 41 is required to be written with, the first end 42 can be withdrawn from the headphone socket, gripping onto the circumferential indentation 56 on the second end, and pulling the circumferential rib 46 past the resilient retaining mechanism. The writing device 41 can be used either on its own by a user holding it between their fingers, i.e. as a conventional pen or pencil, or the second end 48 of the writing device 41 can be inserted into and retained by the headphone socket.

In this latter configuration, as shown in FIGS. 5 to 7, because the second end 48 of the writing device 41 is slightly wider than the first end 42 it gives a tighter fit in the headphone socket, which compensates for its shorter length, enabling it to be held securely in the headphone socket. The writing device 41 can then be used as shown in FIG. 7, with the mobile phone 50 being held to write with the writing device 41.

Figure 9:
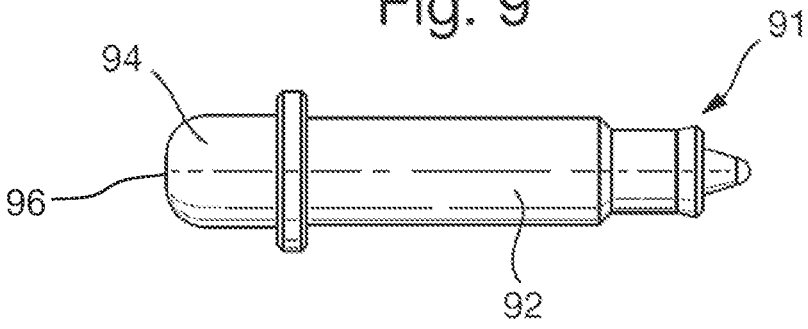
FIGS. 9 to 11 show various views of other embodiments of a writing device.
Figure 10:
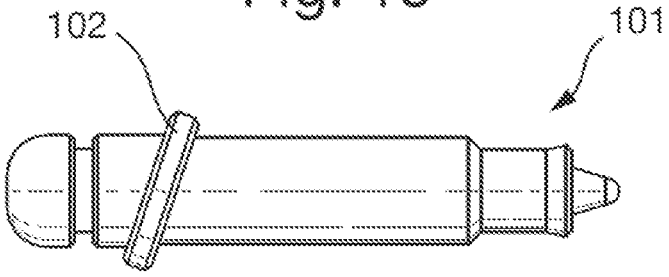
Figure 11:
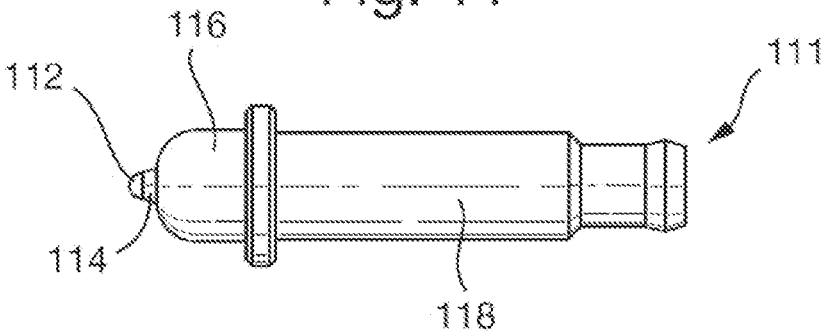

FIGS. 9 to 11 show side views of further embodiments of the writing device, which are variants of the embodiments shown in FIGS. 1 to 4.

FIG. 9 shows a side view of a writing device 91 which has a first end 92 which has the same shape as that shown in FIG. 4. The second end 94 does not have a circumferential indentation but rather is cylindrical with a constant cross-section and a rounded terminal tip 96. The second end 94 is formed from a softer plastic which is capacitive and can be used as a stylus on capacitive touch screens.

FIG. 10 shows a side view of a writing device 101 which has the same general shape as that shown in FIG. 4, but with a circumferential collar 102 that is in a plane at an oblique angle to the main axis of the writing device 101. This collar is suitable for abutting against the sloped casing of a mobile phone, e.g. such as those made by Samsung® and HTC®.

FIG. 11 shows a side view of a writing device 111 which has the same general shape as that shown in FIG. 4, but without the circumferential indentation. The other difference is that the nib 112 of the writing device 111 is provided at the terminal tip 114 of the second end 116, rather than at the first end 118. In this embodiment the first end 118 is rotatable with respect to the second end 116 about the main axis of the writing device 111, such that in operation rotation of the two ends reveals and withdraws the nib 112. This means that the writing device 111 can remain in situ with the first end 118 retained in the headphone socket of a mobile phone and the writing device simply rotated to reveal the nib 112, rather than having to remove the writing device 111 from the headphone socket as in the other embodiments shown.

It will be appreciated by those skilled in the art that only a small number of possible embodiments have been described and that many variations and modifications are possible within the scope of the invention. For example the electronic device need not be a mobile phone but could be any suitable device which includes a headphone socket. The writing device need not dispense a pigment when written with but could be formed as a stylus.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A writing device and electronic device in combination, the combination comprising:

an electronic device including a headphone socket; and an elongated writing device including a first end and a second end, wherein, the first end is shaped to be received by and releasably retained in the headphone socket of the electronic device;

wherein, the second end is shaped to allow a user to withdraw the writing device from the headphone socket of the electronic device when the first end is retained in the headphone socket; and wherein, in a housed configuration, the first end is releasably retained in the headphone socket and the second end is exposed remote from the electronic device; and in a writable configuration, the second end is releasably retained in the headphone socket and the first end is exposed remote from the electronic device to enable the writing device, in combination with the electronic device, to be used to write with.

2. The combination of claim 1, wherein the first end comprises a nib.

3. The combination of claim 2, wherein the nib is arranged to dispense a pigment when used to write on a surface.

4. The combination of claim 3, wherein the pigment is ink and the writing device further comprises a cavity to store the ink.

5. The combination of claim 2, wherein the nib is shaped such that it can be used as a stylus.

6. The combination of claim 1, wherein the second end comprises a nib, wherein the nib comprises a stylus.

7. The combination of claim 1, wherein the electronic device is a mobile phone.

8. The combination of claim 1, wherein the second end is shaped such that it may be received by and releasably retained in the headphone socket of the electronic device.

9. The combination of claim 1, wherein the headphone socket and the first end of the writing device are configured to be rotationally symmetric about respective longitudinal axes of the headphone socket and the writing device.

10. The combination of claim 1, wherein the second end is shaped not to be received by or retained in the headphone socket of the electronic device.

11. The combination of claim 1, wherein the first end is shaped to engage with a resilient retaining mechanism located in the headphone socket.

12. The combination of claim 11, wherein the first end comprises a circumferential rib, collar or groove at its terminal end which engages with the resilient retaining mechanism.

13. The combination of claim 1, wherein the second end comprises a circumferential collar which protrudes in a direction generally perpendicular to the length, at the boundary between the first and second ends.

14. The combination of claim 1, wherein the second end comprises a circumferential indentation to aid withdrawal of the writing device from the headphone socket.

15. An elongate writing device comprising:

a first end; and a second end;

wherein, the first end is sized and shaped to be received by and releasably retained in the headphone socket of an electronic device;

wherein the second end is shaped to allow a user to withdraw the writing device from the headphone socket of the electronic device when the first end is retained in the headphone socket; and wherein in a housed configuration, the first end is releasably retained in the headphone socket and the second end is exposed remote from the electronic device; and in a writable configuration, the second end is releasably retained in the headphone socket and the first end is exposed remote from the electronic device to enable the writing device to be used to write with.

16. The device of claim 15, wherein the first end comprises a nib.

17. The device of claim 16, wherein the nib is arranged to dispense a pigment when used to write on a surface.

18. The device of claim 17, wherein the pigment is ink and the writing device further comprises a cavity to store the ink.

19. The device of claim 16, wherein the nib is shaped such that it can be used as a stylus.

20. The device of claim 15, wherein the second end comprises a nib, the nib comprising a stylus.

21. The device of claim 15, wherein the second end is shaped such that it may be received by and releasably retained in the headphone socket of the electronic device.

22. The device of claim 15, wherein the second end is shaped not to be received by or retained in the headphone socket of the electronic device.

23. The device of claim 15, wherein the first end is shaped to engage with a resilient retaining mechanism located in the headphone socket.

24. The device of claim 23, wherein the first end comprises a circumferential rib, collar or groove at its terminal end which engages with the resilient retaining mechanism.

25. The device of claim 15, wherein the second end comprises a circumferential collar which protrudes in a direction generally perpendicular to a length of the device, at the boundary between the first and second ends.

26. The device of claim 15, wherein the second end comprises a circumferential indentation to aid withdrawal of the writing device from the headphone socket.

* * * * *